US008500263B2

(12) United States Patent
Taya

(10) Patent No.: US 8,500,263 B2
(45) Date of Patent: Aug. 6, 2013

(54) INKJET PRINTING METHOD AND INKJET PRINTING APPARATUS

(75) Inventor: Akihiro Taya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 12/909,156

(22) Filed: Oct. 21, 2010

(65) Prior Publication Data

US 2011/0096120 A1 Apr. 28, 2011

(30) Foreign Application Priority Data

Oct. 27, 2009 (JP) ..... 2009-246799

(51) Int. Cl.
*B41J 2/17* (2006.01)

(52) U.S. Cl.
USPC ..... 347/95; 347/96

(58) Field of Classification Search
USPC ..... 347/95–96
See application file for complete search history.

(56) References Cited

U.S. PATENT DOCUMENTS

| | | | |
|---|---|---|---|
| 7,297,454 | B2 | 11/2007 | Ma et al. |
| 8,132,878 | B2 | 3/2012 | Takekoshi et al. |

FOREIGN PATENT DOCUMENTS

| | | |
|---|---|---|
| JP | 2002-144551 | 5/2002 |
| JP | 2002-200743 | 7/2002 |
| JP | 2004-059933 | 2/2004 |
| JP | 2006-272934 | 10/2006 |

*Primary Examiner* — Jason Uhlenhake

(74) *Attorney, Agent, or Firm* — Fitzpatrick, Cella, Harper & Scinto

(57) ABSTRACT

An inkjet printing method and an inkjet printing apparatus are provided which can realize equal smoothness in both a printed area and in a non-printed area and produce a printed material having a uniform glossiness over the entire printed image. To this end, the clear ink is applied in two phases—a first phase that makes the print medium impenetrable by applying highly penetrative clear ink to the print medium stepwise or intermittently in a small volume at a time and a second phase that applies in a short period of time a greater volume of clear ink than that applied in the first phase of clear ink application. With this process, a clear ink layer of a uniform thickness is formed in both the printed area and the non-printed area on the surface of the print medium made impenetrable by the first phase.

14 Claims, 9 Drawing Sheets

INKJET PRINTING METHOD AND INKJET PRINTING APPARATUS

BACKGROUND OF THE INVENTION

1. Field of the Invention

The present invention relates to an inkjet printing method and an inkjet printing apparatus.

2. Description of the Related Art

A large number of inkjet printing apparatus are available today which realize a high level of image fastness by using a water-based dispersion pigment ink (hereinafter referred to simply as a "pigment ink"). Materials printed with a pigment ink, though excellent in water fastness and light fastness or image fastness, have a drawback that the printed images lack glossiness. This is because the pigment ink does not penetrate deep into the print medium and easily fixes on the print medium surface, thus tending to form undulations on the surface and degrade the smoothness of image surface. In recent years, therefore, there has been a growing call for an inkjet printing technology that can improve the glossiness of image as well as the image fastness.

Japanese Patent Laid-Open No. 2002-144551 discloses a technology whereby a transparent resin (clear ink) is used in addition to the pigment ink for image printing and applied to an area printed with the pigment ink to improve the image fastness and the glossiness of the printed material.

Further, Japanese Patent Laid-Open No. 2004-059933 discloses a technology that improves the glossiness of a non-printed area that is not applied with the pigment ink, by applying a clear ink containing a pore-closing polymer to a porous or semi-porous print medium. With Japanese Patent Laid-Open No. 2004-059933, if the print medium is not glossy, such as plain paper, it is possible to produce a printed material as if the print medium itself is glossy.

Further, Japanese Patent Laid-Open No. 2002-200743 discloses a method of applying the clear ink to an entire image area after it has been printed. Another Japanese Patent Laid-Open No. 2006-272934 discloses a technology that applies the clear ink to the entire image area, as with Japanese Patent Laid-Open No. 2002-200743, and which changes the amount of clear ink applied from one area to another according to the amount of pigment ink applied. More specifically, the volume of clear ink to be applied is reduced in areas where a large volume of pigment ink has been applied, while the clear ink volume is increased where the volume of pigment ink applied is small, thereby aiming to produce a uniform glossiness over the entire image area including non-printed areas and printed areas.

It is, however, still difficult to realize a uniform glossiness over the entire image area including printed areas and non-printed areas, even with any of the above technologies.

The method of Japanese Patent Laid-Open No. 2002-144551, for example, applies the clear ink only to the areas printed with the pigment ink, so the glossiness in the non-printed areas that are not applied with the pigment ink cannot be improved. That is, if the print medium itself does not have a glossiness, it is not possible to produce a printed material having a glossiness over the entire image. Conversely, with Japanese Patent Laid-Open No. 2004-059933, since the clear ink is not applied to the areas printed with the pigment ink, the undulations in the printed area can not be removed. That is, whether the clear ink is applied only to the printed areas, as in Japanese Patent Laid-Open No. 2002-144551, or only to the non-printed areas, as in Japanese Patent Laid-Open No. 2004-059933, a uniform glossiness cannot be obtained over the entire image area including the printed areas and the non-printed areas.

As for the methods disclosed in Japanese Patent Laid-Open Nos. 2002-200743 and 2006-272934, since the clear ink is applied both to the printed areas and the non-printed areas, the glossiness of the entire image area can be expected to be improved. However, even with these methods, since the state of clear ink penetration into the surface of a print medium differs between a position where the pigment ink has been applied and a position not applied with the pigment ink, the undulations in the entire image area are not corrected enough, resulting in a poor glossiness.

The inks that can be used on inkjet printers, including clear ink, can generally be classified into a high-penetrative ink that can easily penetrate into a print medium and a low-penetrative ink that tends to remain on the surface of the print medium for a relatively long time. If the clear ink used is a highly penetrative ink, it forms an appropriate film layer over a pigment ink layer in the areas that have already been printed with the pigment ink, whereas it is quickly absorbed into the print medium in non-printed areas where the pigment ink has not been applied. That is, although the glossiness can be improved in the printed areas, the glossiness improvement cannot be obtained in the non-printed areas.

If, on the other hand, the clear ink is a low-penetrative ink, it forms an appropriate film layer and fixes on the print medium in the non-printed areas. But in the printed areas, the clear ink accumulates on top of the pigment ink, forming additional undulations on the print medium surface. Therefore, although the clear ink can improve the glossiness in the non-printed areas, it degrades the glossiness in the printed areas.

In other words, it has been difficult for an inkjet printing apparatus using a clear ink to produce a printed material that realizes equal levels of smoothness both in the printed areas applied with the pigment ink and in the non-printed areas not applied with the pigment ink and also a uniform glossiness over the entire image formed.

SUMMARY OF THE INVENTION

The present invention has been accomplished to solve the aforementioned problems. It is therefore an object of this invention to provide an inkjet printing method and an inkjet printing apparatus that can produce a printed material that realizes equal levels of smoothness both in the printed areas and in the non-printed areas and also a uniform glossiness over the entire image formed.

The first aspect of the present invention is an inkjet printing method to form an image on a print medium by using a pigment ink containing chromatic pigment materials and an achromatic clear ink more penetrative into the print medium than the pigment ink, the method comprising: a printing step to print an image by applying the pigment ink to the print medium; a first-phase clear ink application step to apply the clear ink to the print medium stepwise or intermittently in a small volume at a time; and a second-phase clear ink application step, executed after the printing step and the first-phase clear ink application step, to apply to the print medium a greater volume of the clear ink in a short period of time than in the first-phase clear ink application step.

The second aspect of the present invention is an inkjet printing method to form an image on a print medium by causing a print head, which is configured to eject a pigment ink containing chromatic pigment materials and an achromatic clear ink more penetrative into the print medium than the pigment ink, to perform a plurality of printing scans at the same scan speed over a same image area of the print medium, the method comprising: a first-phase clear ink application step to apply the clear ink to the same image area in a predetermined number of printing scans; and a second-phase clear ink application step, executed after the predetermined number of printing scans, to apply the clear ink to the same image area in a smaller number of printing scans than the predetermined number; wherein each of the predetermined number of printing scans in the first-phase clear ink application step has a print permission rate lower than that of each of the smaller number of printing scans in the second-phase clear ink application step.

The third aspect of the present invention is an inkjet printing apparatus to form an image on a print medium by using a pigment ink containing chromatic pigment materials and an achromatic clear ink more penetrative into the print medium than the pigment ink, the apparatus comprising: a printing unit configured to print an image by applying the pigment ink to the print medium; a first-phase clear ink application unit configured to apply the clear ink to the print medium stepwise or intermittently in a small volume at a time; and a second-phase clear ink application unit configured to apply to the print medium a greater volume of the clear ink in a short period of time than does the first-phase clear ink application unit after the printing by the printing unit and the clear ink application by the first-phase clear ink application unit.

The fourth aspect of the present invention is an inkjet printing apparatus to form an image on a print medium by causing a print head, which is configured to eject a pigment ink containing chromatic pigment materials and an achromatic clear ink more penetrative into the print medium than the pigment ink, to perform a plurality of printing scans at the same scan speed over a same image area of the print medium, the apparatus comprising: a printing unit configured to apply the clear ink to the same image area in a predetermined number of printing scans and, after the predetermined number of printing scans, apply the clear ink to the same image area in a smaller number of printing scans than the predetermined number of printing scans; wherein the printing unit applies the clear ink to the same image area such that each of the predetermined number of printing scans has a print permission ratio lower than that of each of the smaller number of printing scans.

Further features of the present invention will become apparent from the following description of exemplary embodiments with reference to the attached drawings.

DESCRIPTION OF THE EMBODIMENTS

An example embodiment of this invention will be described in detail. In this embodiment, a pigment ink for printing an image and a high-penetrative clear ink are used. The pigment ink is a color ink and it may be prepared for one color (mono-color) or may be prepared for a plurality of colors, such as cyan, magenta, yellow and black. The clear ink is a colorless ink made by dissolving vinyl resin(styrene acrylic resin with an acid value of 140) in water and adding to it organic solvent and surfactant.

This invention is characterized in that the clear ink is applied to the print medium in two separate phases. The first phase of clear ink application has a role of making the print medium surface impenetrable (by covering exposed parts of the print medium surface) to make it difficult for the clear ink applied in the second phase to get absorbed in the print medium. The second phase of clear ink application is intended to form a smoothing layer over the impenetrable print medium surface already covered with the clear ink in the first phase of application.

Figure 6B:
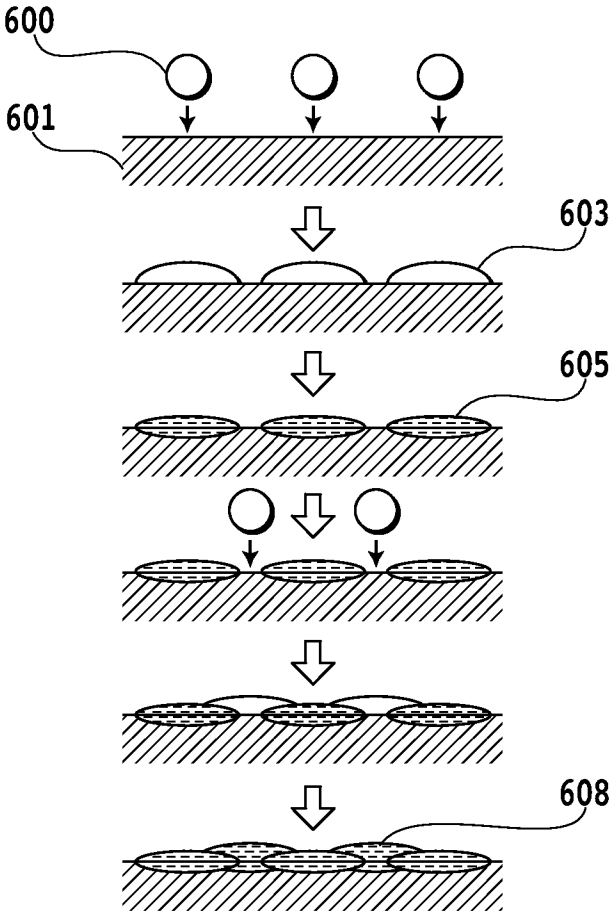
FIGS. 6A and 6B are schematic diagrams showing different modes of clear ink application and states of fixing of the applied clear ink on the print medium.
Figure 6A:
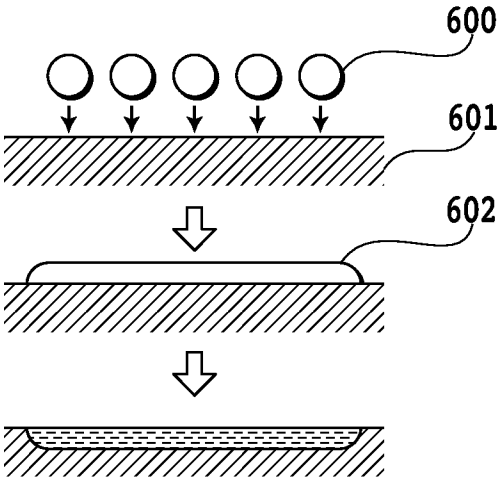

FIGS. 6A and 6B schematically show a clear ink application process and how the clear ink applied is fixed on the print medium. FIG. 6A shows a state of clear ink when a large number of its drops 600 are applied in a single ink ejection operation, while FIG. 6B shows a state of clear ink when it is applied in a few ink ejection operations, each with a small number of droplets.

When a large number of clear ink droplets are applied in high density as shown in FIG. 6A, individual droplets come into contact with one another and merge into a large liquid film 602. Then the high-penetrative clear ink is absorbed in the print medium 601 relatively quickly, with almost no clear ink remaining on the surface of the print medium.

On the other hand, when a small number of droplets are applied at a low density, as shown in FIG. 6B, a plurality of small liquid films 603 are formed, remaining out of contact with one another. These small liquid films 603 have a greater surface area-to-volume ratio than the large liquid film 602, and are more likely to evaporate into the air. As a result, solid lumps 605 of clear ink are formed on the surface of the print medium 601, although the clear ink itself is highly penetrative. That is, compared with the clear ink application method shown in FIG. 6A, the application method in FIG. 6B is more likely to result in the clear ink remaining on the print medium surface. After this, if a small number of liquid droplets are applied again where there are no solid lumps 605, new solid lumps are formed by the same phenomenon, thus creating a solid layer 608 over the surface layer of the print medium 601.

As described above, even if a high-penetrative clear ink is used, the application of clear ink in a plurality of ink ejection operations, each with a small number of droplets, can form a solid layer into which the liquid cannot easily penetrate on the surface of the print medium. So, the first phase of clear ink application in this embodiment to make the print medium surface impenetrable involves applying the clear ink stepwise or intermittently in several ink ejection operations in a small volume at a time, as shown in FIG. 6B. It is noted here that the expression of "applying the clear ink in a small volume at a time" means applying ink at a low density such that ink droplets applied at one time will not be in contact with one another or merge together on the surface of the print medium.

In this embodiment, there is no particular limitation to the time relation between the first phase of clear ink application and the pigment ink printing. It is possible to execute the first phase of clear ink application followed by the pigment ink printing or conversely to execute the pigment ink printing followed by the first phase of clear ink application. It is also possible to execute the first phase of clear ink application and the pigment ink printing simultaneously. This is because the pigment ink itself does not easily penetrate into the print medium and thus the ink fixing state and therefore the printed image quality are not affected greatly by the presence or absence of the solid layer.

Figure 7B:
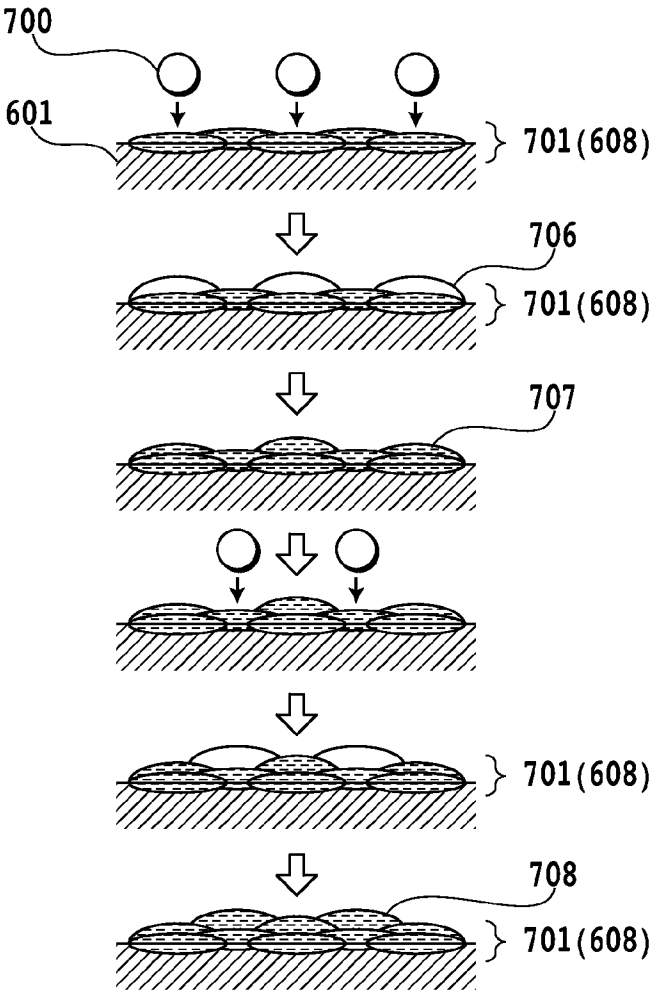
FIGS. 7A and 7B are schematic diagrams showing different modes of clear ink application and states of fixing of the applied clear ink in an image area that has already undergone the printing of pigment ink and the first phase of clear ink application.
Figure 7A:
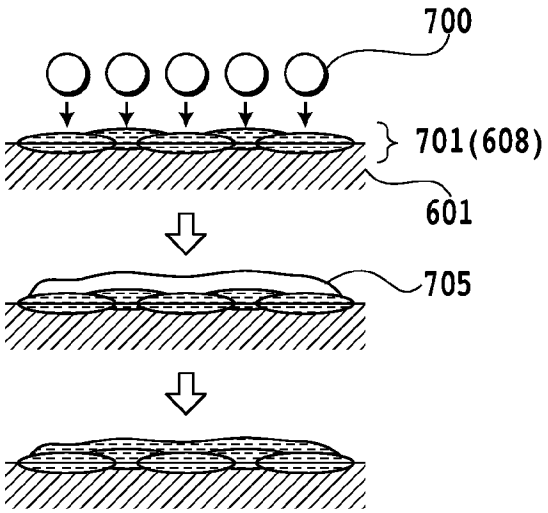

FIGS. 7A and 7B are schematic diagrams showing a process of applying a clear ink to an image area on the print medium where the printing of the pigment ink and the first phase of clear ink application have already been executed, and also how the clear ink droplets fix. FIG. 7A shows a state wherein a large number of clear ink droplets 700 are applied to a pigment ink layer 701 (or solid layer 608) in a single ejection operation; and FIG. 7B shows a state wherein the clear ink is applied in a few ink ejection operations, each with a small number of droplets.

If a large number of liquid droplets are applied at high density as shown in FIG. 7A, individual liquid droplets will come into contact with one another or merge, forming a large clear ink film 705. At this time, undulations of the solid layer 608 formed in the first phase of clear ink application and those of the printed pigment ink dots are all covered with the liquid film 705, smoothing their surface. The liquid film 705 solidifies (fixes) as is, without penetrating into the print medium 601 already covered with the solid layer. As a result, the image area where the pigment ink printing has been executed has a smooth, glossy surface.

If, on the other hand, a small number of liquid droplets are applied at low density, as shown in FIG. 7B, a plurality of small liquid films 706 are formed, remaining out of contact with one another. These small liquid films 706 have a large surface area-to-volume ratio, tend to evaporate easily, and don't penetrate into the print medium 601 already covered with the solid layer. As a result, the liquid films 706 solidify (fix) as is, forming new solid lumps 707. Then, if a small number of liquid droplets are applied again, new solid lumps 708 are formed by the same phenomenon, covering the surface of image area with a plurality of undulated solid lumps. That is, the surface of the image area where the pigment ink printing has been executed has a poor glossiness.

Because of what has been described above, the second phase of clear ink application to form a smoothing layer on the print medium adopts an ink application method of applying a large volume of clear ink at one time in a short period of time, as shown in FIG. 7A. Here the expression of "applying a large volume of clear ink in a short period of time" means applying ink at a high density and in a short duration such that the ink droplets applied will come into contact with one another to merge together.

As described above, this embodiment applies the clear ink in two phases onto an image area on the print medium where an image is formed with a pigment ink. In the first phase, the clear ink is applied stepwise or intermittently in several small-volume ink ejection operations, as shown in FIG. 6B. In the second phase, a large volume of clear ink is applied at once in a short period of time, as shown in FIG. 7A. Applying the clear ink in two phases of different ink ejection modes in this manner can produce a printed material with a uniform glossiness over the whole image area including the printed area where a pigment ink is printed and the non-printed area where the pigment ink is not printed.

Figure 8:
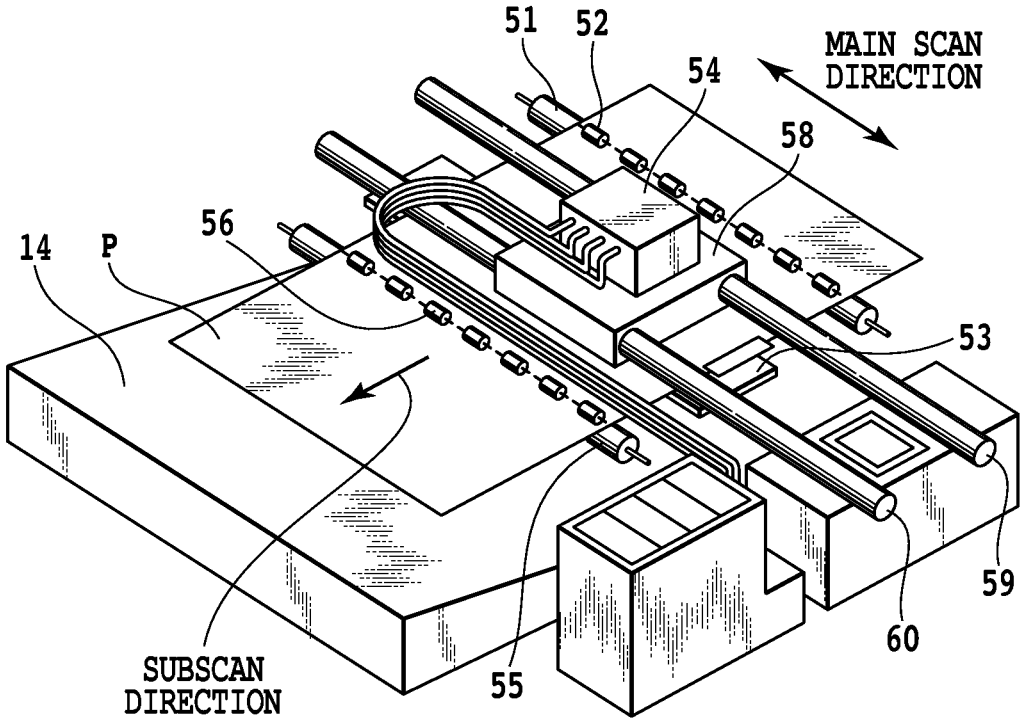
FIG. 8 is a perspective view showing an outline of a printing unit in a serial type inkjet printing apparatus that may be used in this invention.

FIG. 8 is a perspective view showing the outline of a printing unit of a serial type inkjet printing apparatus capable of implementing the above printing method. A print medium P is supplied by an automatic feeding unit, not shown, which is driven by a paper feed motor 310, to a nip portion in a conveyance path between a conveying roller 51 and pinch rollers 52 driven by the conveying roller 51. The print medium is then driven intermittently in a subscan direction in the figure by the rotation of the conveying roller 51.

A platen 53 is located at a print position that opposes a face (ejection face) of the print head 54 that is formed with ink ejection openings and supports the print medium P from the back to keep a distance between the print medium P and the ejection face of the print head 54 constant. The print medium P, once printed on the platen 53, is gripped between a rotating discharge roller 55 and follower spurs 56 and conveyed in the subscan direction until it is thrown onto a discharge tray (not shown).

The print head 54 is mounted on a carriage 58, with its ejection face opposing the platen 53 or the print medium P. The carriage 58 is driven by a carriage motor 309 along two guide rails 59 and 60 in the main scan direction. As the carriage 58 moves in the main scan direction, the print head 54 executes an ink ejection operation in response to a print signal. With the printing operation by the carriage 58 and the print head 54 and the print medium conveying operation alternated, the print medium is formed with an image step by step.

Figure 9:
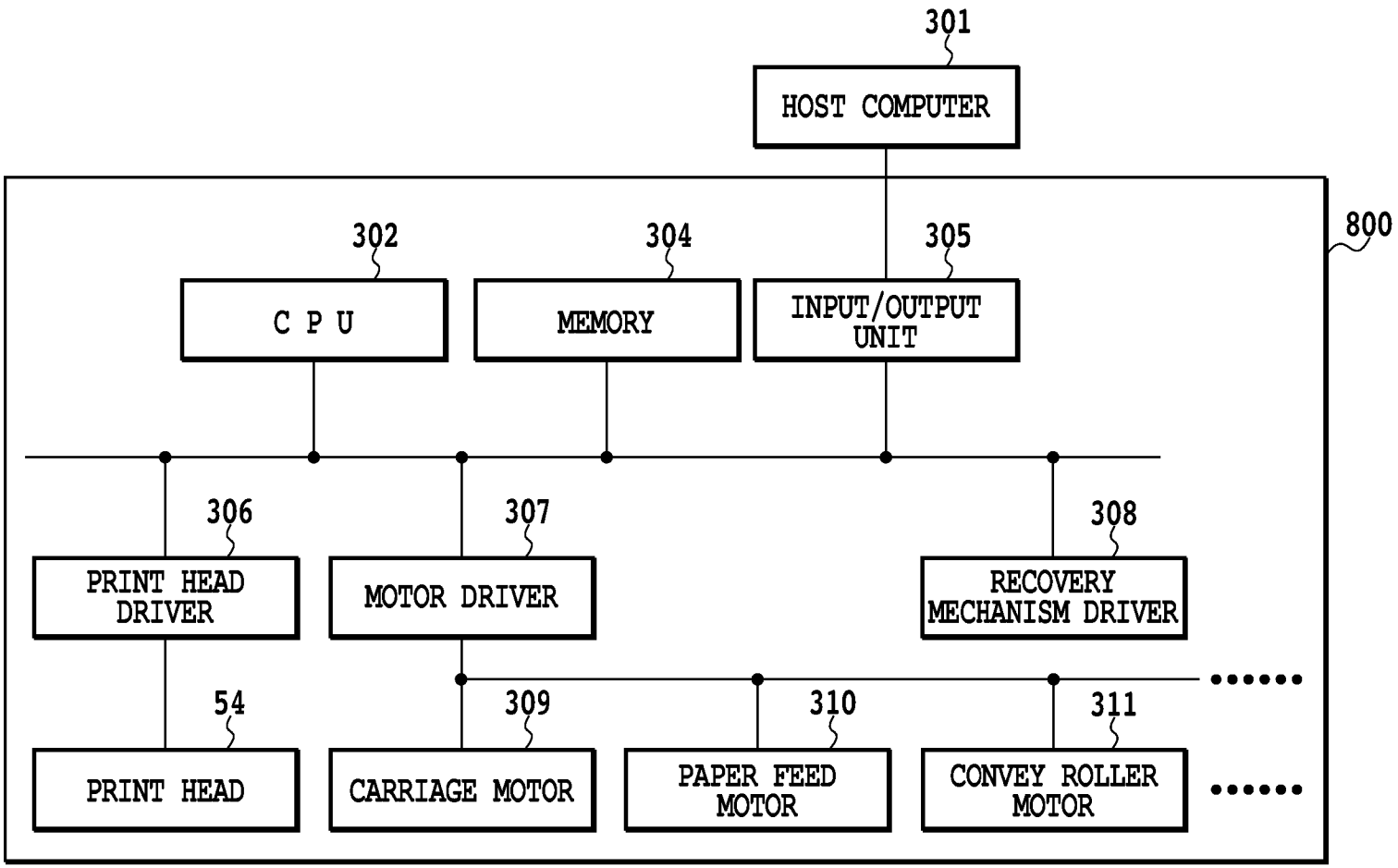
FIG. 9 is a block diagram showing a control configuration of an inkjet printing apparatus that may be used in this invention.

FIG. 9 is a block diagram showing a control configuration of the inkjet printing apparatus that may be used in this embodiment. The printing apparatus 300 of this embodiment produces a glossy printed material according to image data supplied from a host computer 301 through an input/output interface 305. A CPU 302 controls individual units in the apparatus to control the overall operation of the apparatus according to a program stored in the memory 304.

A print head driver 306 causes the print head 54 to eject a pigment ink and a clear ink according to the image data received and mask patterns. A motor driver 307 under the control of the CPU drives the carriage motor 309 to move the carriage 58 in the main scan direction, drives the paper feed motor 310 to operate the automatic paper feed unit and drives a conveying roller drive motor 311 to operate the conveying roller. A recovery mechanism driver 308 under the control of the CPU 302 drives a suction-based recovery pump to execute a maintenance operation on the print head.

Figure 1:
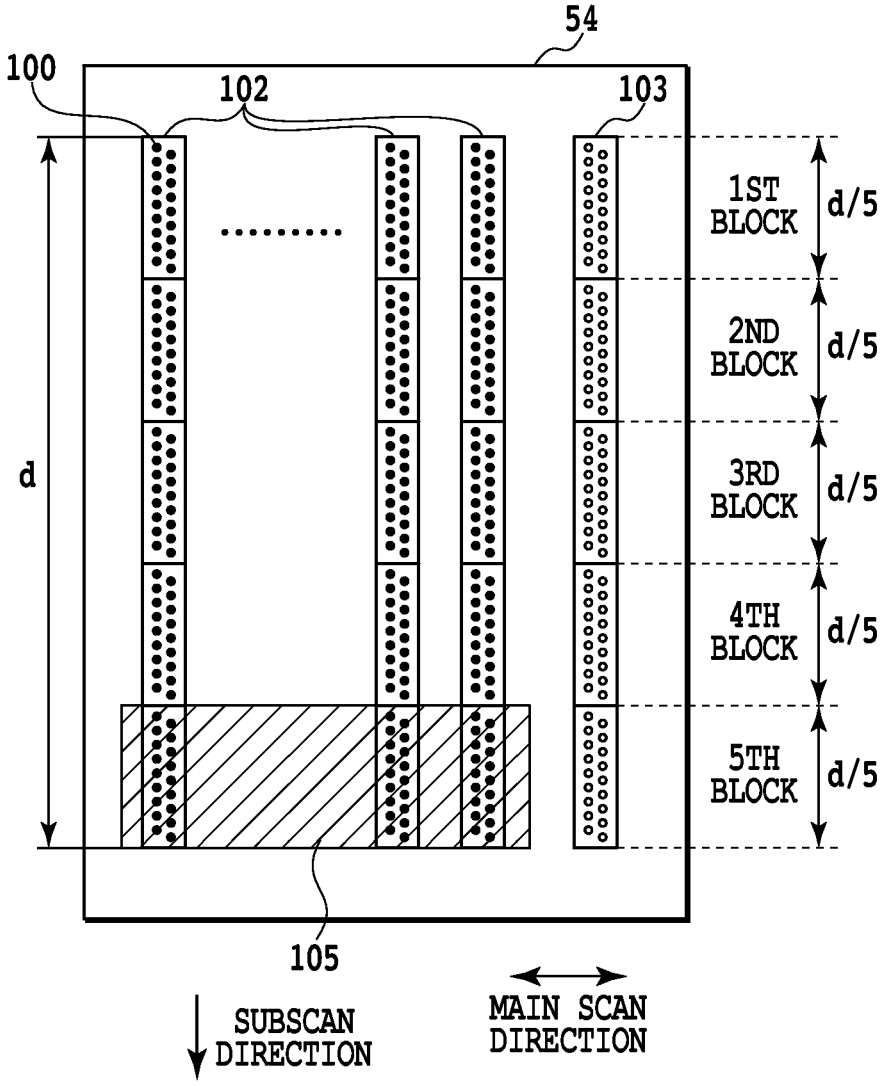
FIG. 1 is a schematic diagram of a print head, as seen from a nozzle-formed face, that may be used in embodiments of this invention.

FIG. 1 is a schematic diagram of the print head 54 as viewed from the ejecting openings formed face. In the figure, reference numeral 102 denotes nozzle arrays for ejecting a pigment ink containing a color pigment; and reference numeral 103 denotes a nozzle array to eject an achromatic clear ink. Each of these nozzle arrays has a width of d in the subscan direction so that a single scan can print over a strip of the width d. Each nozzle array has arranged at a predetermined pitch in the subscan direction nozzles (ejecting openings) 100 for ejecting ink in the form of ink droplets.

The printing apparatus of this embodiment executes a multipass printing. The multipass printing refers to a printing method whereby the print head 54 executes a plurality of printing scans in each area of the width d, that can normally be printed by a single printing scan, to form an image step by step. By conveying the print medium P a distance shorter than d between successive printing scans, unwanted density unevenness and stripes due to variations among individual nozzles can be reduced. Generally, an M-pass printing that completes an image by M printing scans conveys the print medium a distance of d/M in the subscan direction between successively printing scans. In such a multipass printing, an image area having a width of d/M in which an image is completed by the same printing scans will be referred to as a same image area.

This embodiment realizes the above-mentioned two-phase application of clear ink by using a multipass printing. When executing a multipass printing made up of a plurality of printing scans at equal print head scan speeds, a predetermined number of printing scans are allocated to the first phase of clear ink application and a smaller number of printing scans than the predetermined number, executed following the predetermined number of printing scans, are allocated to the second phase. More precisely, this embodiment performs a 5-pass printing, in which first to fourth printing scans on the same image area are allocated to the first phase of clear ink application and a fifth printing scan on the same image area is allocated to the second phase. The operation of the 5-pass printing can be analyzed by dividing each of the nozzle arrays into five blocks, as shown in FIG. 1. The same image area of the print medium, which is conveyed a distance of d/5 in the subscan direction each time one printing scan has been executed, is printed with an image by the first to fifth printing scan of the first to fifth block.

Figure 3A:
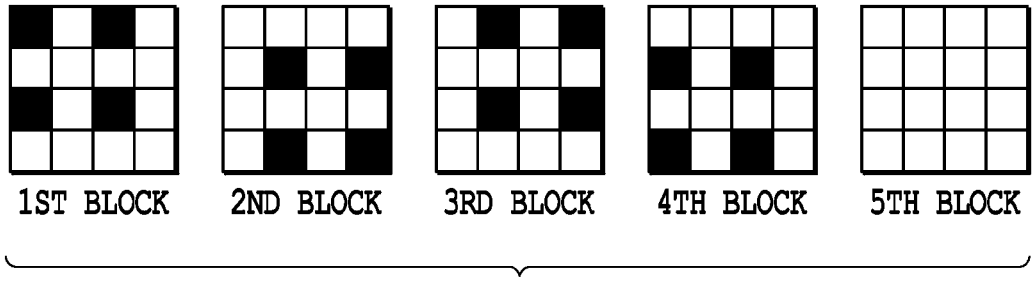
FIGS. 3A and 3B are schematic diagrams showing mask patterns assigned to first to fifth block of nozzle arrays 102 and 103.
Figure 3B:
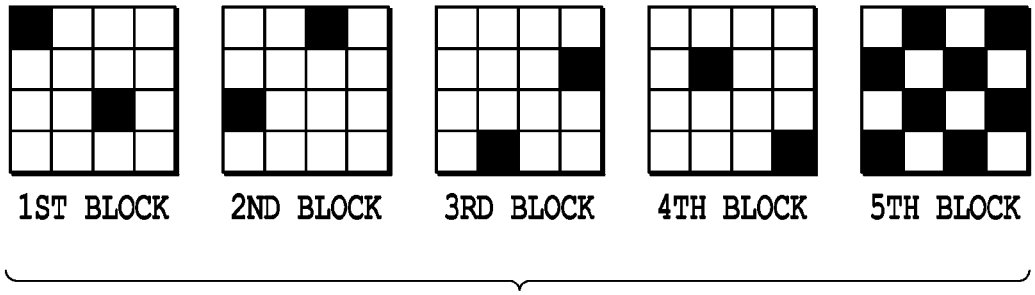

FIGS. 3A and 3B are schematic diagrams showing mask patterns assigned to the first to fifth block of the nozzle arrays 102 and 103. The mask pattern defines whether individual pixels are permitted to be applied with ink (1) or not (0). In the figure, black pixels represent pixels that are permitted to be applied with ink and white pixels represent those not permitted to be applied with ink. As for the pigment ink nozzle arrays 102, a logical AND is taken between the mask pattern of FIG. 3A and binary image data to determine those pixels to be actually printed (i.e., applied with the pigment ink) by the individual blocks. As to the clear ink nozzle array 103, print-permitted pixels (black ones) are always applied with the clear ink by the associated blocks. The mask patterns for the first to fifth block in each of FIGS. 3A and 3B are complementary to one another. These mask patterns are stored in advance in the memory 304 of the printing apparatus 800.

As for the pigment ink nozzle arrays 102, the first to fourth block are assigned mask patterns each with a print permission factor of 25% and the fifth block is assigned a mask pattern that does not permit printing at all (with a print permission rate of 0%). That is, the fifth block of the pigment ink nozzle array 102 is practically a non-ejection region. As for the clear ink nozzle array 103, on the other hand, the first to fourth block are assigned mask patterns each with a print permission rate of 12.5% and the fifth block is assigned a mask pattern with a print permission rate of 50% that enables the block to print the remaining pixel. By performing a multipass printing using such mask patterns, the same image area undergoes the pigment ink application and the first phase of clear ink application in the first to fourth printing scans and then, in the fifth printing scan, is subjected to the second phase of clear ink application. More specifically, in the first phase of clear ink application, the clear ink is applied in four printing scans, each with a print permission rate of 12.5%; and in the second phase, the clear ink is applied to the remaining half of the print-permitted pixel all at once in the fifth printing scan with a print permission rate of 50%. Since the second phase of clear ink application can form a smoothing layer over the image area that has been rendered impenetrable by the first phase of clear ink application, a printed material thus produced has a uniform glossiness over its entire image area.

What the inventors of this invention have conducted to examine the glossiness of a printed material produced by the printing apparatus of the above construction as well as results of the examinations will be explained in the following.

The clear ink is prepared with a composition shown below and then adjusted by a water solution of potassium hydroxide until pH is 9.

Styrene acrylic acid resin (acid value of 140): 4 parts
1,2 hexandiole: 7.5 parts
Surfactant (BYK333): 1 part
Pure water: remaining parts For the pigment ink, PFI-101C made by the applicant of this invention was used. The printing apparatus used was an Inkjet Printer F900 owned by the applicant of this invention. The resolution for printing was set at 1200 dpi (dots/inch) in the subscan direction and 2400 dpi in the main scan direction. Further, the print medium used was LFM-GP101R owned by the applicant of this invention.

Using the multipass printing method described above, this print medium is printed with a pigment ink patch with a duty of 75%. Measurements were made of glossiness in the patch portion on the print medium (printed area) and in a white portion where the pigment ink is not applied (non-printed area). For glossiness measurement, GMX-203 of Murakami Shikisai Gijutsu Kenkyusho K.K. was used. Measurement was made at 20 degrees. For comparison, three kinds of printed materials were prepared using different clear ink application methods than that of this embodiment, though under equal conditions. The glossiness of the comparison examples was also measured.

Figure 5:
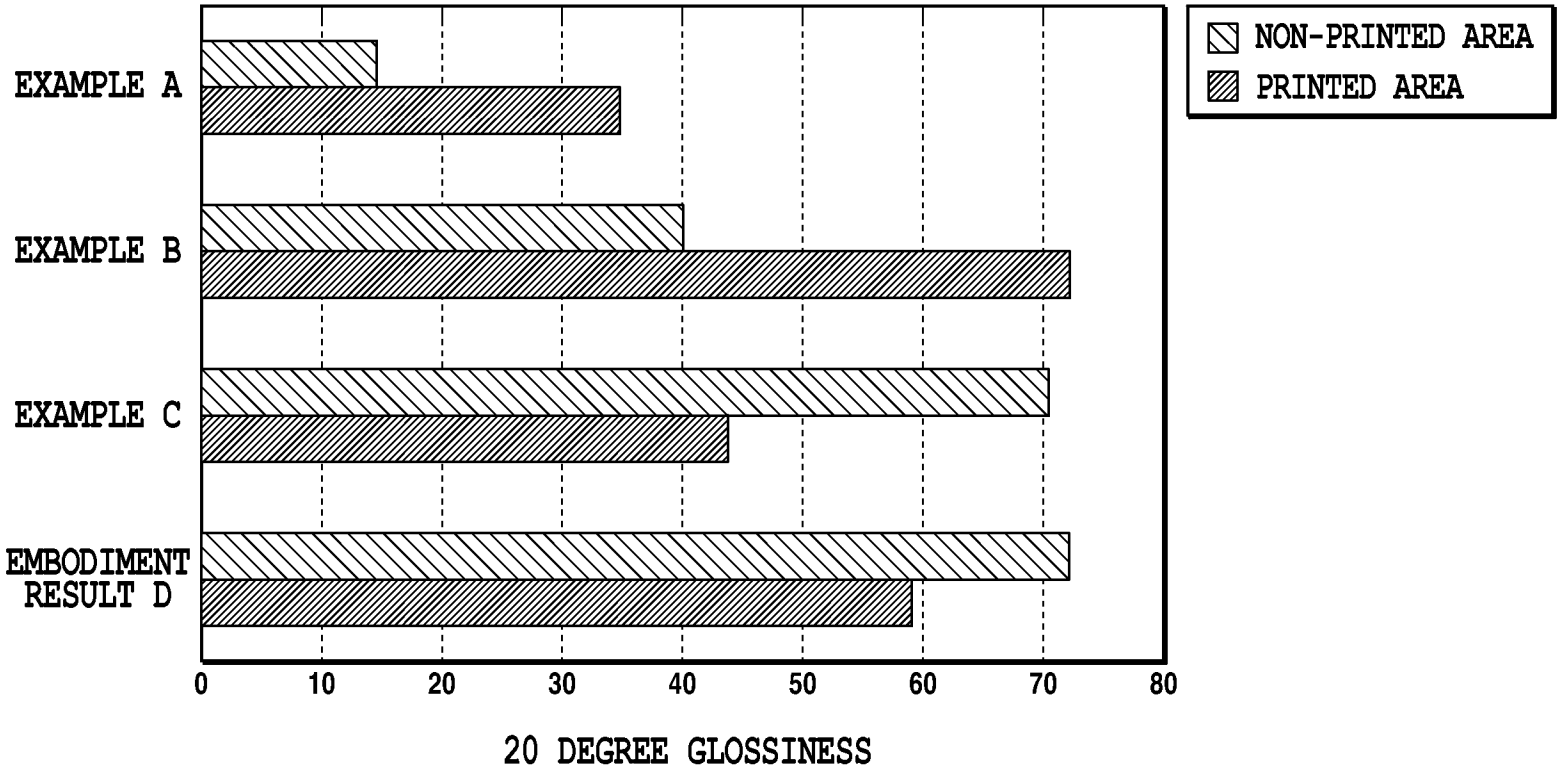
FIG. 5 shows results of measurements of glossiness in this invention and in comparison examples.

FIG. 5 shows the result of measurements of glossiness in this embodiment and in the comparison examples. In the figure, the comparison example A shows glossiness in the printed area and non-printed area when a patch is printed using only the pigment ink, and no clear ink, at a 75% duty. The comparison example B shows glossiness when the first phase of clear ink application is not performed but the second phase of clear ink application is executed at a 50% duty in a single printing scan. The comparison example C shows glossiness when the first phase of clear ink application is not performed but the second phase of clear ink application is executed at a 50% duty in eight printing scans. The result D shows glossiness of a printed material printed by the method of this embodiment.

As can be seen from the graph, the comparison example A with no clear ink used has low levels of glossiness in both the printed area and the non-printed area. The comparison example B, since it has executed the second phase of clear ink application, has a smoothing layer formed in the printed area applied with the pigment ink, raising the level of glossiness in that area. However, in the non-printed area that is not applied with the pigment ink, since the print medium is not rendered impenetrable, the highly penetrative clear ink penetrates into the print medium without forming a smoothing layer, thus failing to produce a high level of glossiness. In the comparison example C, since clear ink application in eight printing scans has been executed, a clear ink layer of an almost uniform thickness is formed over the surface of the print medium in the non-printed area not applied with the pigment ink; thus in that area, a fairly high level of glossiness is produced. However, in the printed area applied with the pigment ink, since the solid lumps of clear ink are formed over the undulated pigment ink, the undulations remain as is (or are even enhanced by the solid lumps), failing to produce a high level of glossiness. Unlike these comparison examples, the result of test D employing the printing method of this embodiment produces satisfactory effects of both the first phase and second phase of clear ink application, resulting in high levels of glossiness both in the printed area and in the non-printed area.

As described above, since the printing method of this embodiment can form, by the second phase of clear ink application, a smoothing layer over the image area that is rendered impenetrable by the first phase of clear ink application, a printed material with a uniform glossiness over its entire image area can be produced.

(Other Embodiments)

Although in the above embodiment, for simple explanation a mask pattern with a 4×4-pixel area has been taken up for example, other forms of mask pattern may be employed as long as the mask pattern holds the printing rate and the complementary relationship described above. For example, a random mask pattern comprising a larger pixel area may be used.

The number of passes of the multipass printing and the print permission rate in each block are also not limited to those described above. As for the printing of the pigment ink, as the number of passes of the multipass printing increases, the image quality becomes high but the printing speed decreases. As for the application of the clear ink, the first phase of clear ink application needs to be performed in as many passes as can make the print medium sufficiently impenetrable and the second phase is required to be executed in as few passes as can form a satisfactory smoothing layer. Such effect of making print medium impenetrable and of forming a smoothing layer can change depending on various printing conditions, including a printing resolution and an ink ejection volume of the print head or ink compositions. So, the number of multi-passes and the print permission rate in each block need to be adjusted according to various printing conditions to meet the above effects with a good balance between them. While in the above embodiment the scan speeds of the multiple passes have been described to be equal, they may be set different as long as the first phase can "apply the clear ink stepwise or intermittently in a small volume at a time" and the second phase can "apply a large volume of clear ink in a short period of time".

Figure 2:
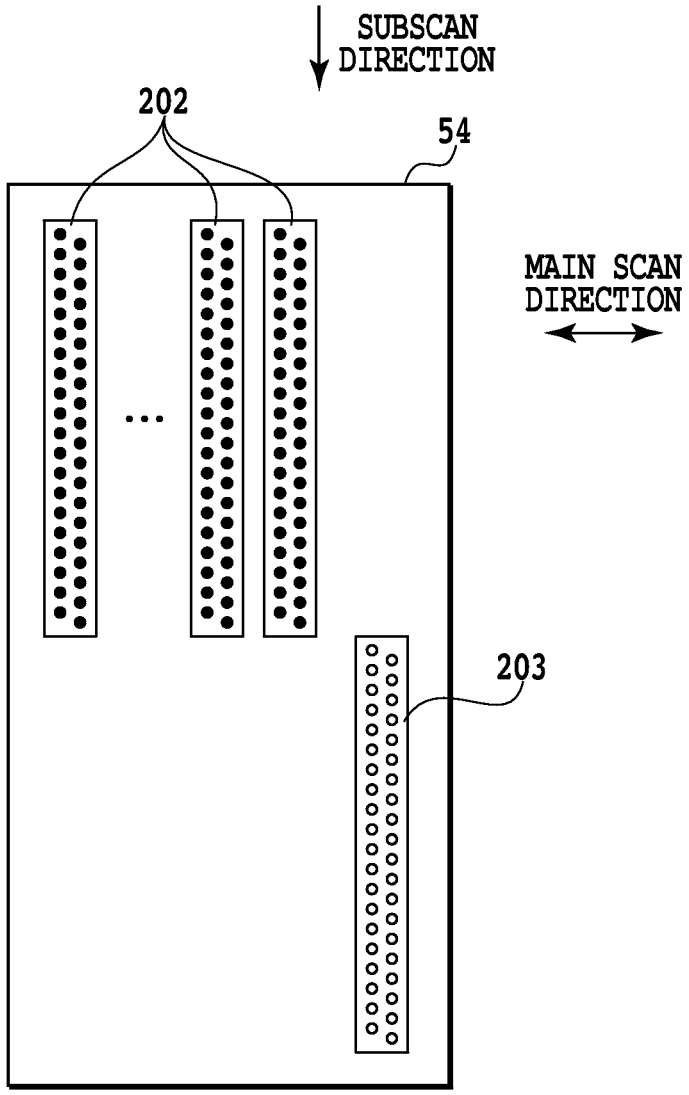
FIG. 2 is a schematic diagram of a print head, as seen from a nozzle-formed face, that may be used in embodiments of this invention.

Furthermore, in the above embodiment, since the print head 54 used has the pigment ink nozzle arrays 102 and the clear ink nozzle array 103 arranged at the same positions in the subscan direction, as shown in FIG. 1, the fifth block of the nozzle arrays 102 becomes practically a non-ejection region. However, if a print head is used which has pigment ink nozzle arrays 202 and a clear ink nozzle array 203 arranged at different positions in the subscan direction, as shown in FIG. 2, all nozzles of the nozzle arrays 202 can be used for printing. In that case, the same image area, after having been printed with the pigment ink completely, undergoes the first phase of clear ink application, followed by the second phase of clear ink application. In addition to the construction in which the pigment ink nozzle arrays 202 and the clear ink nozzle array 203 are completely out of alignment with each other in the subscan direction, as shown in FIG. 2, the print head may have the pigment ink nozzle arrays 202 and the clear ink nozzle array 203 arranged to partly overlap each other.

Figure 4:
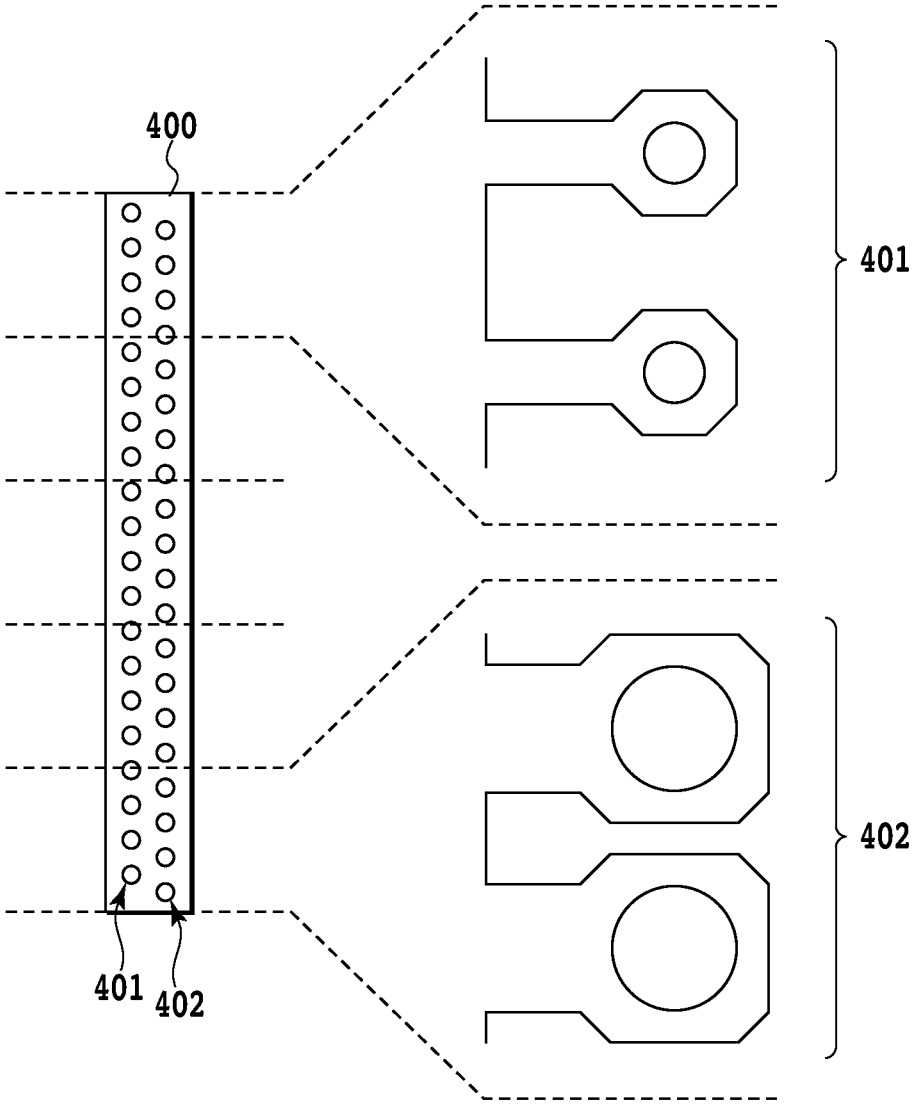
FIG. 4 is a schematic diagram of a print head, as seen from a nozzle-formed face, that may be used in embodiments of this invention.

The advantage of this invention can be obtained by applying the clear ink in two phases—a first phase in which the clear ink is applied stepwise or intermittently in a small volume at a time and a second phase in which the clear ink is applied in a large volume in a short period of time. So, the multipass printing described above does not have to be performed. For example, like a clear ink print head 400 shown in FIG. 4, the print head may have two nozzle arrays—a first nozzle array 401 to eject ink droplets of a relatively small volume and a second nozzle array 402 to eject ink droplets of a relatively large volume—and choose the first or second nozzle array for the first or second phase of clear ink application. In that case, the volume of ink ejected from the first nozzle array 401 should preferably be such that those ink droplets applied simultaneously do not come into contact with one another or merge together on the surface of the print medium. Further, the volume of ink ejected from the second nozzle array 402 should preferably be such that those ink droplets applied at one time come into contact with one another or merge together on the surface of the print medium.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-246799, filed Oct. 27, 2009, which is hereby incorporated by reference herein in its entirety.

What is claimed is:

1. An inkjet printing method to form an image on a print medium by using a pigment ink containing chromatic pigment materials and a clear ink that is achromatic and more penetrative into the print medium than the pigment ink, the method comprising:

a printing step to print an image by applying the pigment ink to the print medium;

a first-phase clear ink application step to apply the clear ink to the print medium stepwise or intermittently in a predetermined volume at a time; and a second-phase clear ink application step, executed after the printing step and the first-phase clear ink application step, to apply to the print medium in a short period of time a greater volume of the clear ink than the predetermined volume of the clear ink applied in the first-phase clear ink application step.

2. An inkjet printing method according to claim 1, wherein the first-phase clear ink application step and the printing step are executed simultaneously.

3. An inkjet printing method according to claim 1, wherein the first-phase clear ink application step is executed after the printing step.

4. An inkjet printing method according to claim 1, wherein the first-phase clear ink application step applies the clear ink stepwise or intermittently by causing a print head ejecting the clear ink to perform a plurality of printing scans over a same image area of the print medium, and wherein the second-phase clear ink application step applies the clear ink in a short period of time by causing the print head to perform the printing scan over the same image area a smaller number of times than that of the plurality of printing scans executed by the first-phase clear ink application step.

5. An inkjet printing method according to claim 4, wherein the second-phase clear ink application step corresponds to a last printing scan over the same image area.

6. An inkjet printing method according to claim 1, wherein the first-phase clear ink application step applies the clear ink stepwise or intermittently by causing a first nozzle array ejecting the clear ink to perform a plurality of printing scans over a same image area of the print medium, and wherein the second-phase clear ink application step applies the clear ink in a short period of time by causing a second nozzle array, which is configured to eject a greater volume of the clear ink than that from the first nozzle array, to perform the printing scan over the same image area.

7. An inkjet printing method to form an image on a print medium by causing a print head, which is configured to eject a pigment ink containing chromatic pigment materials and a clear ink that is achromatic and more penetrative into the print medium than the pigment ink, to perform a plurality of printing scans at the same scan speed over a same image area of the print medium, the method comprising:

a first-phase clear ink application step to apply the clear ink to the same image area in a predetermined number of printing scans; and a second-phase clear ink application step, executed after the predetermined number of printing scans, to apply the clear ink to the same image area in a smaller number of printing scans than the predetermined number, wherein each of the predetermined number of printing scans in the first-phase clear ink application step has a print permission rate lower than that of each of the smaller number of printing scans in the second-phase clear ink application step.

8. An inkjet printing method according to claim 7, wherein the pigment ink is applied to the same image area in the predetermined number of printing scans.

9. An inkjet printing method according to claim 7, wherein the second-phase clear ink application step corresponds to a last printing scan over the same image area.

10. An inkjet printing apparatus to form an image on a print medium by using a pigment ink containing chromatic pigment materials and a clear ink that is achromatic and more penetrative into the print medium than the pigment ink, the apparatus comprising:

a printing unit configured to print an image by applying the pigment ink to the print medium;

a first-phase clear ink application unit configured to apply the clear ink to the print medium stepwise or intermittently in a predetermined volume at a time; and a second-phase clear ink application unit configured to apply to the print medium in a short period of time a greater volume of the clear ink than the predetermined volume of the clear ink applied by the first-phase clear ink application unit after the printing by the printing unit and the clear ink application by the first-phase clear ink application unit.

11. An inkjet printing apparatus according to claim 10, wherein the first-phase clear ink application unit applies the clear ink stepwise or intermittently by causing a print head ejecting the clear ink to perform a plurality of printing scans over a same image area of the print medium, and wherein the second-phase clear ink application unit applies the clear ink in a short period of time by causing the print head to perform the printing scan over the same image area a smaller number of times than the plurality of printing scans executed by the first-phase clear ink application unit.

12. An inkjet printing apparatus according to claim 11, wherein the printing scan over the same image area a smaller number of times corresponds to a last printing scan over the same image area.

13. An inkjet printing apparatus to form an image on a print medium by causing a print head, which is configured to eject a pigment ink containing chromatic pigment materials and a clear ink that is achromatic and more penetrative into the print medium than the pigment ink, to perform a plurality of printing scans at the same scan speed over a same image area of the print medium, the apparatus comprising:

a printing unit configured to apply the clear ink to the same image area in a predetermined number of printing scans and, after the predetermined number of printing scans, apply the clear ink to the same image area in a smaller number of printing scans than the predetermined number of printing scans, wherein the printing unit applies the clear ink to the same image area such that each of the predetermined number of printing scans has a print permission ratio lower than that of each of the smaller number of printing scans.

14. An inkjet printing apparatus according to claim 13, wherein the smaller number of printing scans than the predetermined number of printing scans corresponds to a last printing scan over the same image area.

* * * * *